US008646948B1

(12) United States Patent
Reo et al.

(10) Patent No.: US 8,646,948 B1
(45) Date of Patent: Feb. 11, 2014

(54) LED LIGHTING FIXTURE

(71) Applicants: Ann Marie Reo, Wilmette, IL (US); Chantal Louise Pittman, Wimberley, TX (US)

(72) Inventors: Ann Marie Reo, Wilmette, IL (US); Chantal Louise Pittman, Wimberley, TX (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 13/660,917

(22) Filed: Oct. 25, 2012

Related U.S. Application Data

(63) Continuation of application No. 12/761,990, filed on Apr. 16, 2010, now Pat. No. 8,297,798.

(51) Int. Cl.
*F21V 7/07* (2006.01)
*F21V 7/00* (2006.01)

(52) U.S. Cl.
USPC ..... 362/296.05; 362/241; 362/247; 362/294; 362/373; 362/147

(58) Field of Classification Search
USPC ..... 362/241, 247, 296.5, 294, 373, 147, 362/296.05
See application file for complete search history.

(56) References Cited

U.S. PATENT DOCUMENTS

| | | | |
|---|---|---|---|
| 1,148,341 | A | 7/1915 | Spencer |
| 1,509,379 | A | 9/1924 | Sims |
| 1,974,039 | A | 9/1934 | Gilbert et al. |
| 3,197,902 | A | 8/1965 | Buzan |
| 3,208,173 | A | 9/1965 | Rufus |
| 4,587,755 | A | 5/1986 | Sunshine |
| 5,047,907 | A | 9/1991 | Hawkins |
| D350,566 | S | 9/1994 | Pearson |
| D368,491 | S | 4/1996 | Berardi |
| 5,561,346 | A | 10/1996 | Byrne |
| 5,733,028 | A | 3/1998 | Ramer et al. |
| 5,950,340 | A | 9/1999 | Woo |
| 5,967,652 | A | 10/1999 | Ramer et al. |
| 6,064,061 | A | 5/2000 | Ramer et al. |
| 6,088,091 | A | 7/2000 | Ramer et al. |
| 6,234,648 | B1 | 5/2001 | Borner et al. |
| 6,238,077 | B1 | 5/2001 | Ramer et al. |
| D445,138 | S | 7/2001 | Stark et al. |
| 6,286,979 | B1 | 9/2001 | Ramer et al. |
| 6,334,700 | B2 | 1/2002 | Ramer et al. |
| 6,539,657 | B1 | 4/2003 | Qualis et al. |
| D474,509 | S | 5/2003 | Kim |
| D483,413 | S | 12/2003 | Merenlender |
| 6,698,122 | B1 | 3/2004 | Merenlender |

(Continued)

*Primary Examiner* — Stephen F Husar
*Assistant Examiner* — James Cranson, Jr.
(74) *Attorney, Agent, or Firm* — King & Spalding LLP

(57) ABSTRACT

An lighting fixture includes a reflector, a pedestal, and a lighting module. The reflector includes an opening formed therethrough and the pedestal is positioned in communication with the opening. The lighting module is coupled to the pedestal. In certain embodiments, the reflector is organically shaped and includes four parts, where each part is substantially S-shaped. The lighting module includes a frame and indirect LEDs that emit light toward the interior surface of the reflector. The indirect LEDs are positioned below the lowest portions of the reflector a are positioned at an angle with respect to a horizontal axis. The frame includes a cut-off wall that provides for a cut-off angle for the indirect LEDs and one or more fins. The frame and the pedestal provide thermal management for the LEDs. In certain embodiments, the lighting module also includes one or more of direct LEDs and an active cooling module.

22 Claims, 9 Drawing Sheets

(56) References Cited

U.S. PATENT DOCUMENTS

| | | | | |
|---|---|---|---|---|
| 6,788,256 | B2 | 9/2004 | Hollister | |
| 6,851,834 | B2 | 2/2005 | Leysath | |
| 6,871,993 | B2 | 3/2005 | Hecht | |
| 6,979,097 | B2 | 12/2005 | Elam et al. | |
| 6,995,355 | B2 | 2/2006 | Rains et al. | |
| 7,111,971 | B2 | 9/2006 | Coushaine et al. | |
| 7,150,553 | B2 | 12/2006 | English et al. | |
| 7,204,615 | B2 | 4/2007 | Arik et al. | |
| 7,234,840 | B2 | 6/2007 | Agabekov et al. | |
| 7,347,589 | B2 | 3/2008 | Ge | |
| 7,461,951 | B2 | 12/2008 | Chou et al. | |
| D611,547 | S | 3/2010 | Mirica et al. | |
| 7,722,220 | B2 * | 5/2010 | Van De Ven | 362/294 |
| 7,815,327 | B2 | 10/2010 | Shamshoian | |
| 8,066,407 | B2 | 11/2011 | Remus et al. | |
| 2005/0279949 | A1 | 12/2005 | Oldham et al. | |
| 2006/0225326 | A1 | 10/2006 | Robinson et al. | |
| 2007/0069882 | A1 | 3/2007 | Mahajan | |
| 2007/0139938 | A1 | 6/2007 | Petroski et al. | |
| 2007/0147046 | A1 | 6/2007 | Arik et al. | |
| 2007/0247853 | A1 | 10/2007 | Dorogi | |
| 2008/0025047 | A1 | 1/2008 | Speier et al. | |
| 2008/0151541 | A1 | 6/2008 | Heffington et al. | |
| 2008/0278943 | A1 | 11/2008 | Der Poel et al. | |
| 2008/0285271 | A1 | 11/2008 | Roberge et al. | |
| 2008/0298069 | A1 | 12/2008 | Chu | |
| 2008/0316482 | A1 | 12/2008 | Hoshizaki et al. | |
| 2009/0001372 | A1 | 1/2009 | Arik et al. | |
| 2009/0009996 | A1 | 1/2009 | Scordino et al. | |
| 2010/0107462 | A1 | 5/2010 | Lee | |

* cited by examiner

LED LIGHTING FIXTURE

CROSS REFERENCE TO RELATED APPLICATIONS

This patent application is a continuation of and claims priority under 35 U.S.C. §120 to U.S. patent application Ser. No. 12/761,990 titled "LED Lighting Fixture" filed on Apr. 16, 2010, the entire content of which is hereby incorporated by reference herein.

TECHNICAL FIELD

The present invention relates generally to lighting fixtures. More specifically, the present invention relates to lighting fixtures using solid state light emitters, e.g., light emitting diodes ("LEDs").

BACKGROUND

One particular type of light fixture is known as a lay-in luminaire, or a troffer. A troffer is typically installed within a suspended ceiling grid system where one or more ceiling tiles are replaced with the troffer. Thus, the exterior dimensions of the troffer are typically sized to fit within the regular spacing of the ceiling tiles. In the United States, the spacing of the ceiling grid is often two feet by two feet and, therefore, troffers used in the United States typically have dimensions that are a multiple of two feet. For example, many troffers are two feet by two feet or two feet by four feet. Although one example of a typical ceiling grid spacing is provided, the spacing can be greater or less in other examples. The troffer typically houses one or more fluorescent tubes for providing illumination to a desired illuminated area.

Although, fluorescent tubes are more efficient than some types of lamps, such as incandescent light bulbs, they are still less efficient than solid state light emitters, such as LEDs. A significant percentage of electricity that is generated in the United States goes towards lighting applications. As the demand for and the cost of generating electricity has risen over the years, utility companies and other governmental agencies have begun promoting the use of more efficient ways to generate light. Thus, there has been a shift of consumers desiring to use light fixtures having solid state light emitters from light fixtures using other types of lamps, such as fluorescent tubes.

Conventional approaches to providing solid state light emitters in a suspended ceiling grid system include replacing fluorescent tubes found within typical troffers with an LED lamp shaped into the size of the fluorescent tube. Such an approach utilizes existing fluorescent troffer fixtures and replaces just the lamp. Another approach to providing solid state light emitters for a suspended ceiling grid system includes providing a solid state lighting luminaire that looks similar to a lensed troffer, where a lens sheet is provided between the solid state light sources and the desired illuminated area. The solid state light sources are oriented and pointed towards the desired illuminated area. In this approach, a heat sink is generally coupled to the troffer along its top side so that it lies above the ceiling plane and is not visible to an end-user standing within the desired illuminated area.

A challenge with solid state light emitters is that many solid state light emitters do not operate well in high temperatures. For example, many LED light sources have average operating lifetimes of decades, but some LEDs' lifetimes are significantly shortened if they are operated at elevated temperatures.

Thus, efficient heat removal from the LEDs enable longer LED lifetimes. One issue arising in conventional approaches for providing solid state light emitters in a suspended ceiling grid system is that the heat is transferred from the LEDs to the heat sink located above the ceiling plane; thereby, causing the heat to be trapped within the ceiling area. Hence, the operating temperature of these LEDs soon increase, thereby shortening the life of these LEDs.

A further challenge with solid state light emitters arises from the relatively high light output from a relatively small area provided by solid state emitters. Such a concentration of light output presents challenges in providing solid state lighting systems for general illumination in that large changes in brightness in a small area is perceived as glare and distracting to occupants. It is a challenge to provide uniform lighting when using solid state light emitters within a ceiling grid system.

SUMMARY

An exemplary embodiment of the invention includes a light fixture. The light fixture includes an organic reflector, a pedestal, and a light module. The organic reflector includes a first part, a second part, a third part, and a fourth part. The first part is coupled adjacent the second part and the fourth part and is positioned opposite the third part. The second part is coupled adjacent the first part and the third part and is positioned opposite the fourth part. The third part is coupled adjacent the second part and the fourth part and is positioned opposite the first part. The fourth part is coupled adjacent the first part and the third part and is positioned opposite the second part. Each part collectively forms an opening in the center of the reflector. The pedestal is positioned in communication with the opening. The light module is coupled to the pedestal and includes a light source that emits light to a desired illumination area. Each part of the reflector is substantially S-shaped.

Another exemplary embodiment of the invention includes a light fixture. The light fixture includes a reflector, a pedestal, and a light module. The reflector includes an opening formed therethrough. The pedestal is positioned in communication with the opening. The light module is coupled to the pedestal and includes a frame and one or more indirect LEDs. The frame includes a top surface, a bottom surface, an intermediate edge, an indirect LED mounting platform, a cut-off wall, and one or more fins. The intermediate edge is positioned at a vertical elevation that is between the vertical elevations of the top surface and the bottom surface. The indirect LED mounting platform is located adjacent to the intermediate edge and includes an inner edge and an outer edge. The inner edge is positioned at a vertical elevation that is higher than the vertical elevation of the outer edge. The cut-off wall extends from the outer edge to the intermediate edge. The fins are coupled to the cut-off wall and the indirect LED mounting platform and extend to the top surface and the bottom surface. The indirect LEDs are coupled to the indirect LED mounting platform and emit light towards the interior surface of the reflector. The cut-off wall forms a cut-off angle of the indirect LEDs.

Another exemplary embodiment of the invention includes a light fixture. The light fixture includes an organic reflector, a pedestal, and a light module. The organic reflector includes a first part, a second part, a third part, and a fourth part. The first part is coupled adjacent the second part and the fourth part and is positioned opposite the third part. The second part is coupled adjacent the first part and the third part and is positioned opposite the fourth part. The third part is coupled adjacent the second part and the fourth part and is positioned opposite the first part. The fourth part is coupled adjacent the first part and the third part and is positioned opposite the second part. Each part collectively forms an opening in the center of the reflector. The pedestal is positioned in communication with the opening. The light module is coupled to the pedestal and includes a frame and one or more indirect LEDs. The frame includes a top surface, a bottom surface, an intermediate edge, an indirect LED mounting platform, a cut-off wall, and one or more fins. The intermediate edge is positioned at a vertical elevation that is between the vertical elevations of the top surface and the bottom surface. The indirect LED mounting platform is located adjacent to the intermediate edge and includes an inner edge and an outer edge. The inner edge is positioned at a vertical elevation that is higher than the vertical elevation of the outer edge. The cut-off wall extends from the outer edge to the intermediate edge. The fins are coupled to the cut-off wall and the indirect LED mounting platform and extend to the top surface and the bottom surface. The indirect LEDs are coupled to the indirect LED mounting platform and emit light towards the interior surface of the reflector. The indirect LEDs are positioned below the lowest portion of the reflector. The cut-off wall forms a cut-off angle of the indirect LEDs, which range between about twenty-five degrees and about fifty degrees. Each part of the reflector is substantially S-shaped.

BRIEF DESCRIPTION OF THE DRAWINGS

The foregoing and other features and aspects of the invention are best understood with reference to the following description of certain exemplary embodiments, when read in conjunction with the accompanying drawings, wherein.

Figure 1:
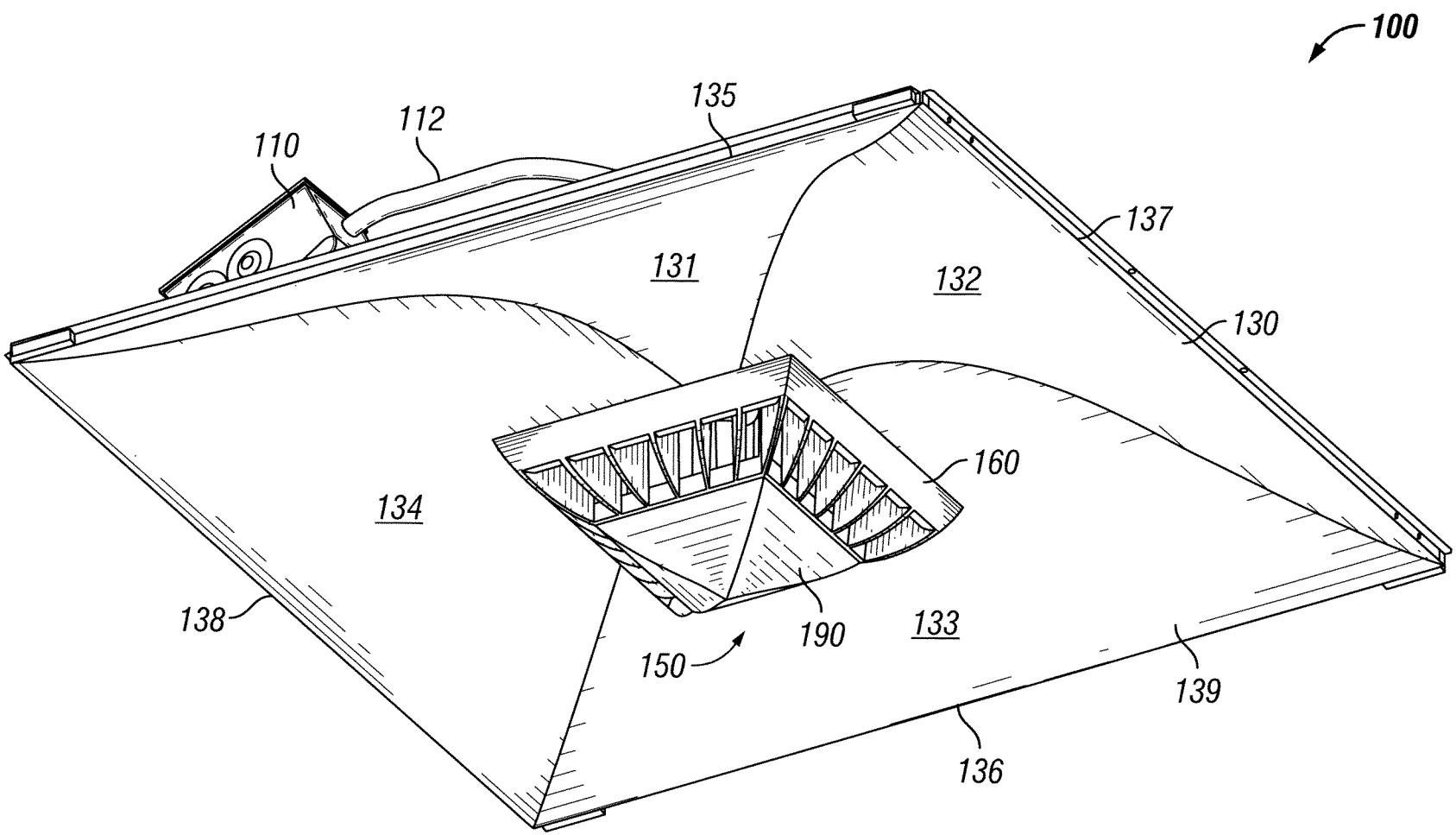
FIG. 1 is a bottom perspective view of a light fixture in accordance with an exemplary embodiment of the present invention.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The present invention is directed to lighting fixtures using solid state light emitters, e.g., LEDs. The invention is better understood by reading the following description of non-limiting, exemplary embodiments with reference to the attached drawings, wherein like parts of each of the figures are identified by like reference characters, and which are briefly described as follows.

Figure 2:
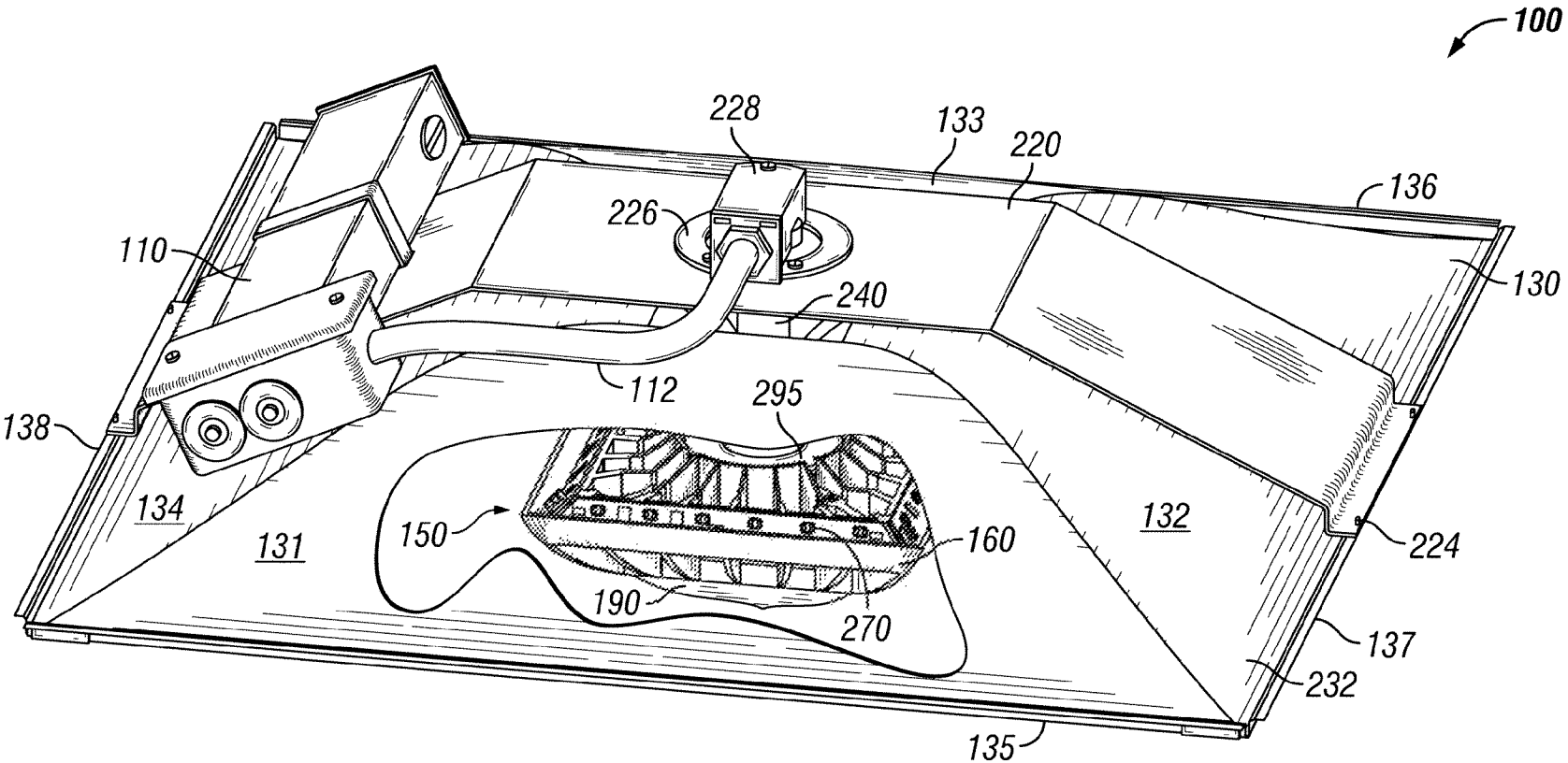
FIG. 2 is a top perspective view of the light fixture of FIG. 1 having a portion of the reflector cut away in accordance with an exemplary embodiment of the present invention.
Figure 3A:
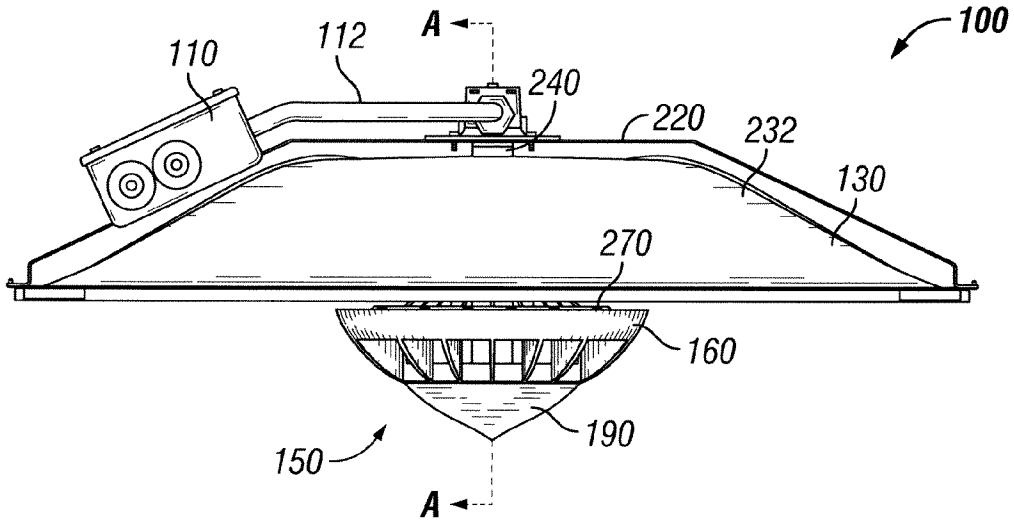
FIG. 3A is a side elevational view of the light fixture of FIG. 1 in accordance with an exemplary embodiment of the present invention.
Figure 3B:
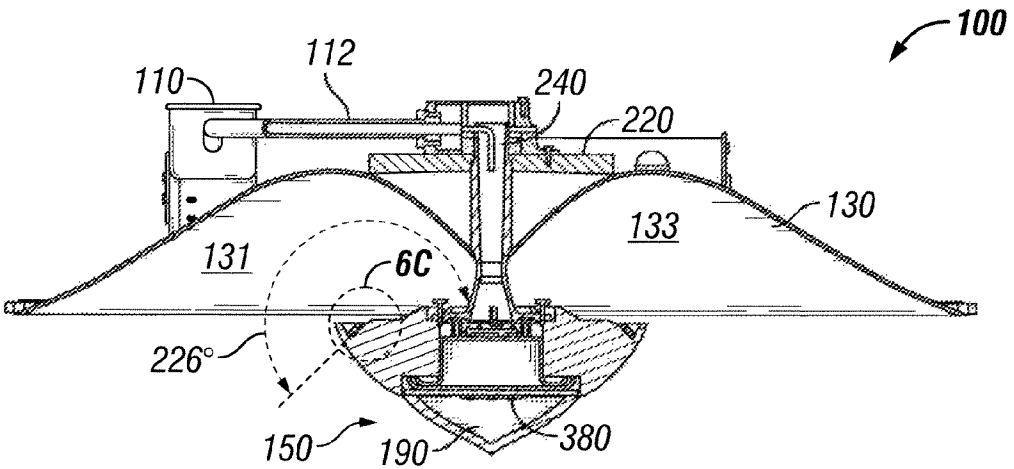
FIG. 3B is a cross sectional view of the light fixture of FIG. 3A taken along line A-A in accordance with an exemplary embodiment of the present invention.

FIG. 1 is a bottom perspective view of a light fixture 100 in accordance with an exemplary embodiment of the present invention. FIG. 2 is a top perspective view of the light fixture 100 of FIG. 1 having a portion of the reflector 130 cut away in accordance with an exemplary embodiment of the present invention. FIG. 3A is a side elevational view of the light fixture 100 of FIG. 1 in accordance with an exemplary embodiment of the present invention. FIG. 3B is a cross sectional view of the light fixture 100 of FIG. 3A taken along line A-A in accordance with an exemplary embodiment of the present invention. Referring to FIGS. 1-3B, the light fixture 100 includes a reflector 130, a driver 110, a pedestal 240, and a light module 150. In certain exemplary embodiments, the light fixture 100 includes a bracket 220 for supporting the driver 110 and/or the pedestal 240. The light module 150 includes a frame 160, one or more indirect LEDs 270, one or more direct LEDs 380, a lens 190, and one or more active cooling devices 295. However, in certain exemplary embodiments, one or more of the active cooling devices 295, the lens 190, and/or the direct LEDs 380 are optional.

Figure 4:
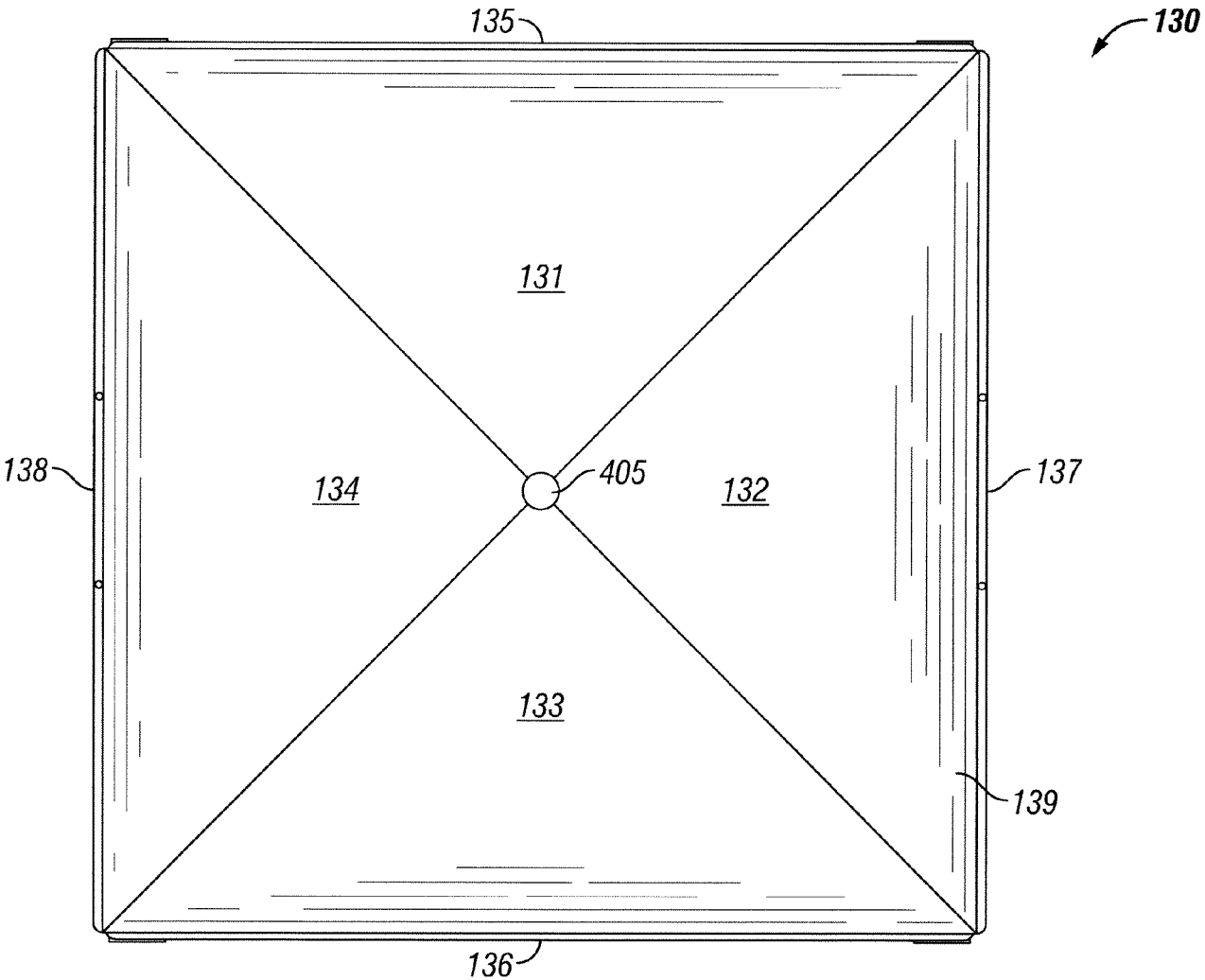
FIG. 4 is a bottom view of the reflector of the light fixture of FIG. 1 having the light module and the pedestal removed in accordance with an exemplary embodiment of the present invention.

FIG. 4 is a bottom view of the reflector 130 of the light fixture 100 of FIG. 1 having the light module 150 (FIG. 1) and the pedestal 240 (FIG. 2) removed in accordance with an exemplary embodiment of the present invention. Referring to FIGS. 1-4, the reflector 130 is a four-part geometric-shaped reflector that is fabricated using a single formed metal. The reflector 130 includes a first part 131, a second part 132, a third part 133, and a fourth part 134. The reflector 130 also includes a first lateral edge 135, a second lateral edge 136, a first longitudinal edge 137, and a second longitudinal edge 138. The first lateral edge 135 is located on an opposite edge of the reflector 130 than the second lateral edge 136. Similarly, the first longitudinal edge 137 is located on an opposite edge of the reflector 130 than the second longitudinal edge 138. The first part 131 includes the first lateral edge 135 and is coupled adjacent the second part 132 and the fourth part 134, but is positioned opposite the third part 133. The second part 132 includes the first longitudinal edge 137 and is coupled adjacent the first part 131 and the third part 133, but is positioned opposite the fourth part 134. The third part 133 includes the second lateral edge 136 and is coupled adjacent the second part 132 and the fourth part 134, but is positioned opposite the first part 131. The fourth part 134 includes the second longitudinal edge 138 and is coupled adjacent the first part 131 and the third part 133, but is positioned opposite the second part 132. Each of the four parts 131, 132, 133, and 134 are substantially similar in size and collectively form a square-shaped reflector having an opening 405 formed substantially within the center of the reflector 130. Although the reflector 130 is square-shaped in one exemplary embodiment, the reflector 130 is shaped in any geometric or non-geometric shape in other exemplary embodiments. The opening 405 allows access for the pedestal 240 (FIG. 2) to be inserted therethrough, which is described in further detail below.

The reflector 130 has an interior surface 139 that defines an interior volume and an exterior surface 232. The reflector 130 has a profile that is organically shaped. The profile of the reflector 130 is substantially "M" shaped when viewing a cross-section of the first part 131 and the third part 133, as seen in FIG. 3B. Similarly, the profile of the reflector 130 is substantially "M" shaped when viewing a cross-section of the second part 132 and the fourth part 134. Each part 131, 132, 133, and 134 has a profile that is substantially "S" shaped. In one example, the profile of each part 131, 132, 133, and 134 initially extends and curves upwards from the opening 405, then curves downwards towards a respective edge 135, 136, 137, and 138, and then smoothly transitions into a plane that the respective edge 135, 136, 137, and 138 lies. Thus, in one exemplary embodiment, the curvature angle adjacent to the respective edge 135, 136, 137, and 138 ranges from about zero degrees to about five degrees.

The reflector 130 is approximately two feet by two feet. Thus, the first lateral edge 135, the second lateral edge 136, the first longitudinal edge 137, and the second longitudinal edge are all approximately two feet. In certain other exemplary embodiments, the dimensions of the reflector 130 are multiples of approximately two feet, which are typically the dimensions of ceiling tiles that the light fixture 100 is installed therein. The length of the first lateral edge 135 is substantially the same as the length of the second lateral edge 136. Similarly, the length of the first longitudinal edge 137 is substantially the same as the length of the second longitudinal edge 138. Although some exemplary dimensions are provided, the dimensions are alterable, and not dependent to being multiples of two feet, according to other exemplary embodiments.

The reflector 130 is formed from a single component sheet metal; however, the reflector 130 can be formed from multiple components and thereafter coupled together using methods known to people having ordinary skill in the art, for example, welding or fastening one or more components together. Although sheet metal is one exemplary material that is used to manufacture the reflector 130, other suitable materials known to people having ordinary skill in the art can be used without departing from the scope and spirit of the exemplary embodiments. The interior surface 139 is finished to be reflective to light using methods known to people having ordinary skill in the art. For example, the interior surface 139 can be polished, coated with a reflective material, fabricated using a reflective material, or made reflective using other methods known to people having ordinary skill in the art.

The driver 110 is electrically communicable with the light module 150 using a cable 112. Cable 112 is a conduit that allows electrical wires to pass therewithin, which supplies power to the light module 150 from the driver 110. One end of the cable is coupled to the driver 110, while the other end is coupled to a connector 228, which is described in further detail below. Specifically, the driver 110 provides power to the indirect LEDs 270, the direct LEDs 380, and the active cooling device 295. The driver 110 is a dual output pulse width modulated driver so that the appropriate power is delivered to each of the indirect LEDs 270, the direct LEDs 380, and the active cooling device 295. The power used in the LEDs 270 and 380 is different than the power used in the active cooling device 295. In some exemplary embodiments, the indirect LEDs 270 and the direct LEDs 380 use pulse width modulation for dimming purposes, while the active cooling device 295 uses constant voltage at all times. However, in some exemplary embodiments, either or both the direct LEDs 380 and the active cooling device 295 are optional. In the embodiments where the active cooling device 295 is not present, the driver 110 can be a single output driver without departing from the scope and spirit of the exemplary embodiments.

In some exemplary embodiments, the bracket 220 is coupled to opposing ends of the reflector 130. However, the bracket 220 is coupled to various alternative portions of the reflector 130 in accordance with other exemplary embodiments. According to FIGS. 2 and 3A, the bracket 220 is coupled to a portion of the first longitudinal edge 137 and extends the latitudinal length of the reflector 130 to a portion of the second longitudinal edge 138. The bracket 220 is raised from at least a portion of the exterior surface 232 of the reflector 130. The bracket 220 is coupled to both longitudinal edges 137 and 138 using one or more screws 224. However, in other exemplary embodiments, other fastening means including, but not limited to, rivets, adhesives, and welding can be used to couple the bracket 220 to the reflector 130 without departing from the scope and spirit of the exemplary embodiment. The bracket 220 includes an aperture 226 substantially centrally located lengthwise. The aperture 226 is aligned with the opening 405 (FIG. 4) so that the bracket 220 is capable of providing support to the pedestal 240. The bracket 220 is used for supporting the driver 110 and/or the pedestal 240, which is discussed in further detail below. In exemplary embodiments where the bracket 220 is not used, the driver 110 is located proximally to the reflector 130, such as coupled to a ceiling beam (not shown), and the pedestal 240 is mounted to the reflector 130. In one example, the opening 405 (FIG. 4) of the reflector 130 is redesigned in other exemplary embodiments, where the pedestal 240 is coupled to the a portion of the reflector 130 that surrounds the opening 405 (FIG. 4). The bracket 220 is fabricated using sheet metal; however, other suitable materials known to people having ordinary skill in the art is used in other exemplary embodiments.

The connector 228 is positioned above the aperture 226 and is coupled to the pedestal 240. In some exemplary embodiments, a portion of the connector 228 extends through the aperture 226 and is coupled to the pedestal 240 that passes through the opening 405 (FIG. 4). In other exemplary embodiments, the entire connector 228 is positioned above the aperture 226, while the pedestal 240 extends through the opening 405 (FIG. 4) and the aperture 226 so that it is coupled to the connector 228. The connector 228 allows the electrical wires within the cable 112 to pass through it and extend through the pedestal 240 towards the LEDs 270 and 380 and the active cooling device 295.

Figure 5B:
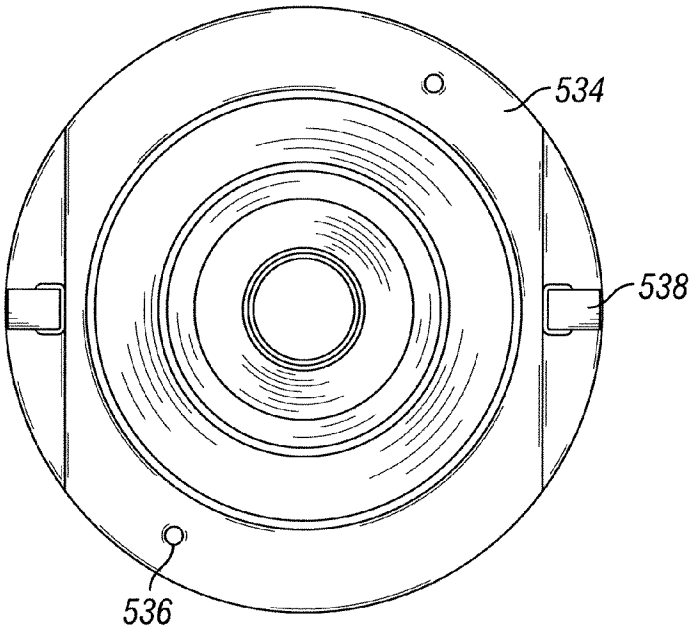
FIG. 5B is a bottom view of the pedestal of FIG. 5A in accordance with an exemplary embodiment of the present invention.
Figure 5A:
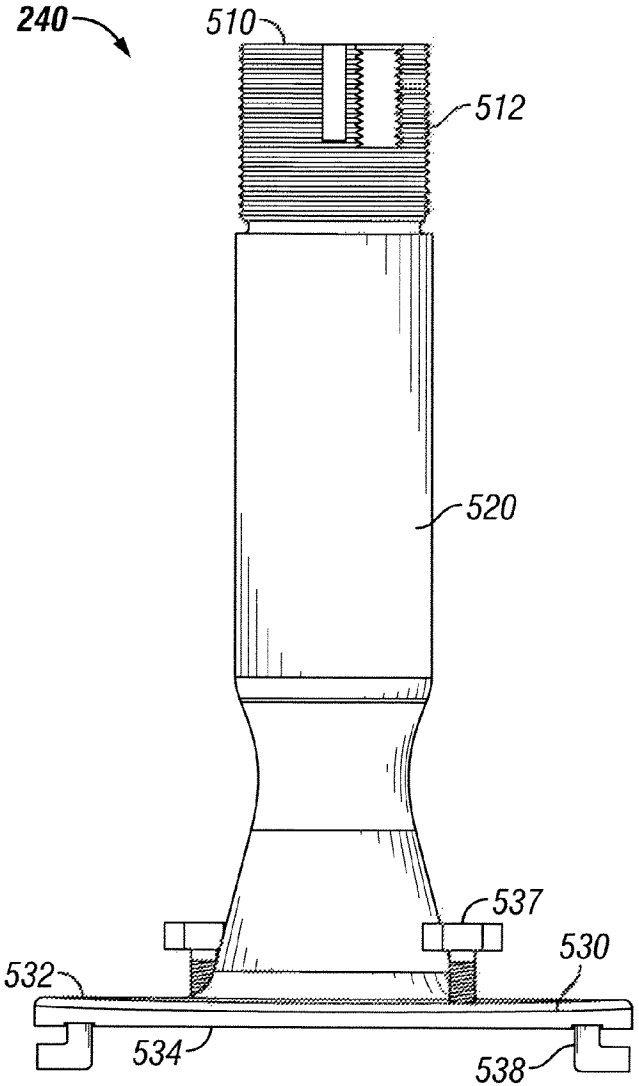
FIG. 5A is a side elevational view of the pedestal of FIG. 2 in accordance with an exemplary embodiment of the present invention.

FIG. 5A is a side elevational view of the pedestal 240 of FIG. 2 in accordance with an exemplary embodiment of the present invention. FIG. 5B is a bottom view of the pedestal 240 of FIG. 5A in accordance with an exemplary embodiment of the present invention. Referring to FIGS. 2, 5A, and 5B, the pedestal 240 includes a first end 510, a body 520, and a second end 530. In some exemplary embodiments, the first end 510, the body 520, and the second end 530 are integrally formed; however, in other exemplary embodiments, one or more components are separately formed and thereafter coupled to one another.

The first end 510 is positioned at one end of the body 520 and is configured to be coupled to the connector 228. In certain exemplary embodiments, the first end 510 includes threads 512 that are threadedly coupled to the connector 228 However, as previously mentioned, the first end 510 can be coupled to either of the bracket 220 or the reflector 130 without departing from the scope and spirit of the exemplary embodiment.

The body 520 is cylindrically shaped and is hollow to allow the electrical wires from the driver 110 to extend through it towards the light module 150. Although the body 520 has a substantially circular perimeter, the perimeter of the body 520 can be any geometric or non-geometric shape including, but not limited to, square perimeter, triangular perimeter, or elliptical perimeter, without departing from the scope and spirit of the exemplary embodiment. The body 520 is fabricated from metal, but is capable of being fabricated from any suitable material known to people having ordinary skill in the art. In certain exemplary embodiments, the body 520 acts as a heat sink and is fabricated using thermally conductive material. A portion of the heat generated from the LEDs 270 and 380 travels to the body 520 and the body 520, in turn, releases at least a portion of the heat to the environment surrounding the body 520. In some exemplary embodiments, the environment surrounding the body 520 is air-conditioned space. In some exemplary embodiments, the environment surrounding the body 520 is located within at least the interior portion of the reflector 130.

The second end 530 is positioned at an opposing end of the body 520 and is configured to be coupled to the light module 150. According to one exemplary embodiment, the second end 530 includes a circular plate that has a top side 532 and a bottom side 534. However, in alternative exemplary embodiment, the second end 530 is any geometric or non-geometric shape that is designed to be coupled to the light module 150. The second end 530 includes one or more passageways 536 extending from the top side 532 to the bottom side 534. The passageways 536 allow respective screws 537, or other known fastening devices, to be inserted therethough which facilitate the coupling of the pedestal 240 to the light module 150. Additionally, the bottom side 534 includes two tabs 538 configured to mate with corresponding locking arms 612 (FIGS. 6D and 7) located on the light module 150. The tabs 538 are integrally formed onto the bottom side 534, but are separately formed and thereafter attached to the bottom side 534 in alternative exemplary embodiments. In other exemplary embodiments, hooks, latches, threading, or other suitable quick-release connectors are used in lieu of, or in addition to, the tabs 538. The tabs 538 are fabricated using a metal, a plastic, a composite, or other suitable material that is sufficiently sturdy and resistant to the heat produced by the LEDs 270 and 380.

Figure 6A:
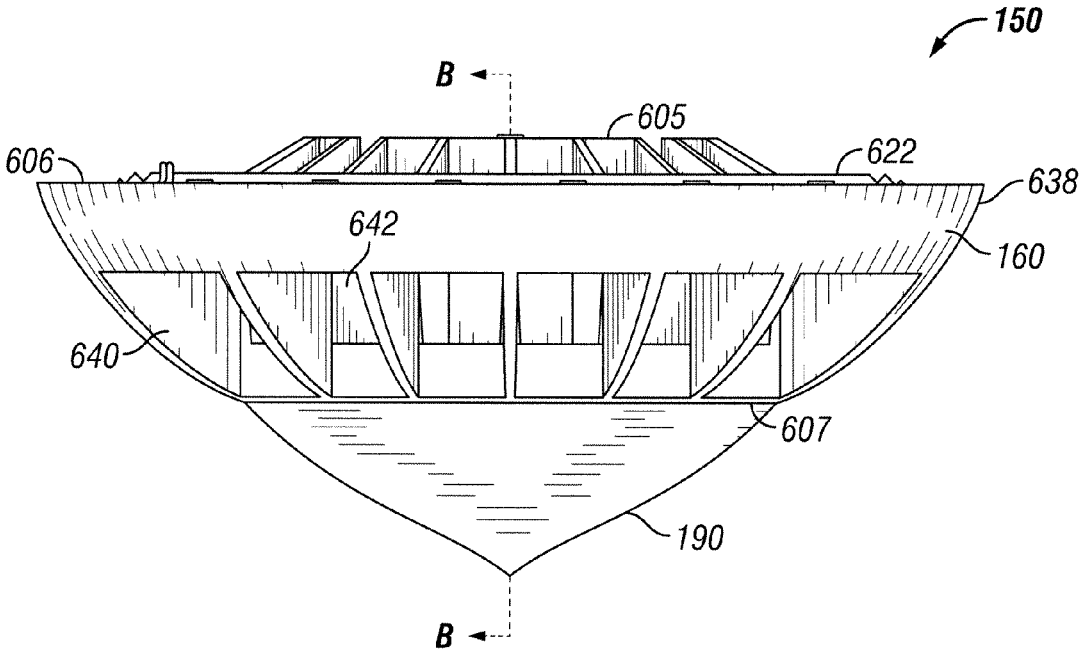
FIG. 6A is a side elevational view of the light module of FIG. 1 in accordance with an exemplary embodiment of the present invention.
Figure 6B:
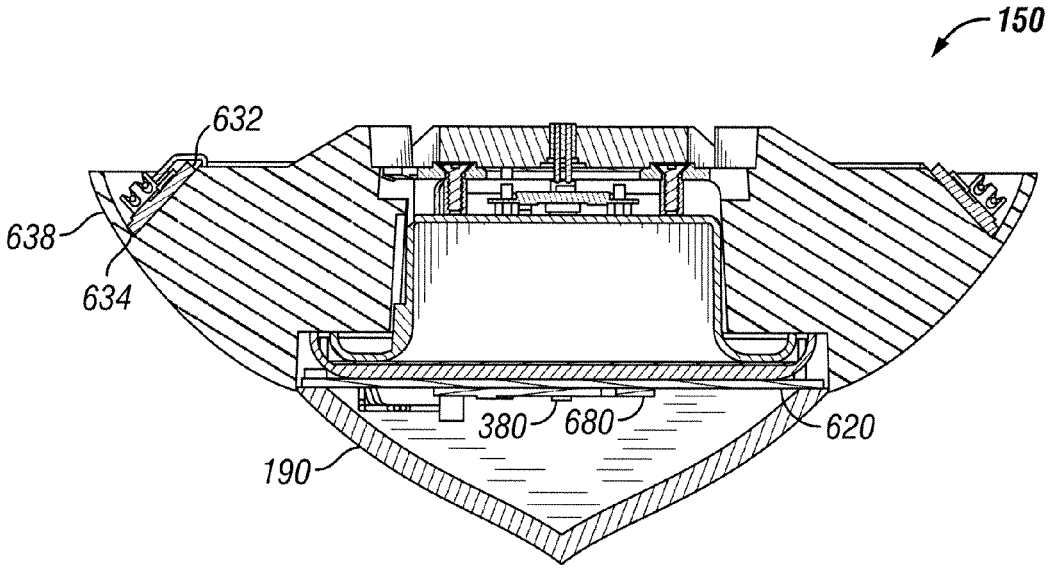
FIG. 6B is a cross sectional view of the light module of FIG. 6A taken along line B-B in accordance with an exemplary embodiment of the present invention.
Figure 6C:
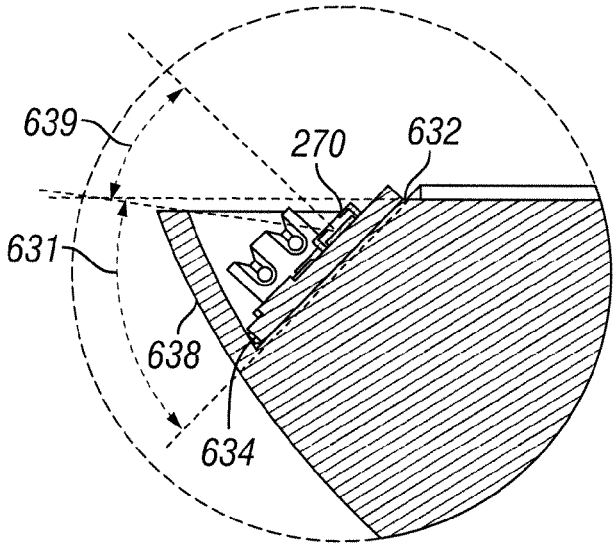
FIG. 6C is a magnified view of a portion of the light module of FIG. 6B in accordance with an exemplary embodiment of the present invention.
Figure 6D:
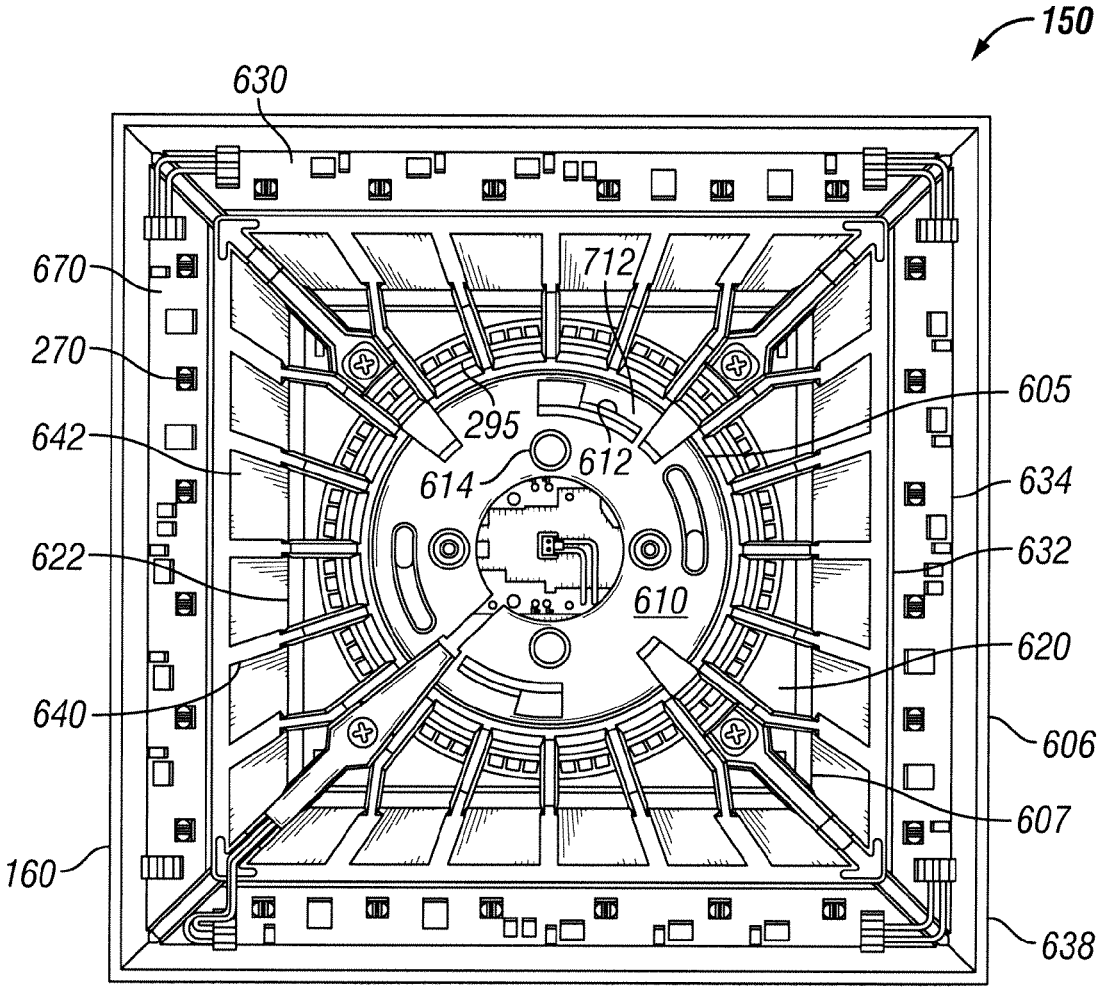
FIG. 6D is a top view of the light module of FIG. 6A in accordance with an exemplary embodiment of the present invention.
Figure 7:
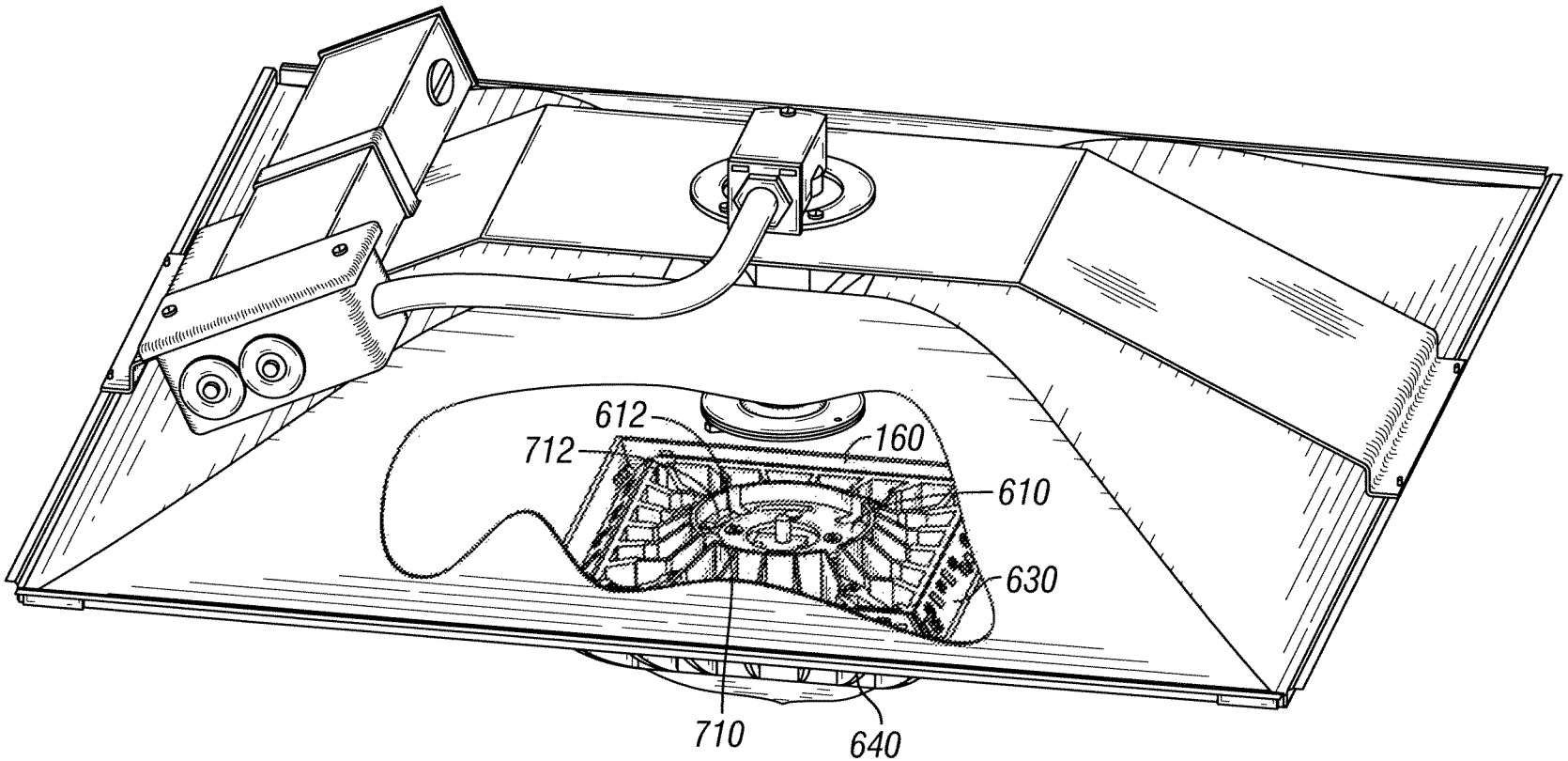
FIG. 7 is an exploded view of the light fixture of FIG. 2 having a portion of the reflector cut away in accordance with an exemplary embodiment of the present invention.

FIG. 6A is a side elevational view of the light module 150 of FIG. 1 in accordance with an exemplary embodiment of the present invention. FIG. 6B is a cross sectional view of the light module 150 of FIG. 6A taken along line B-B in accordance with an exemplary embodiment of the present invention. FIG. 6C is a magnified view of a portion of the light module 150 of FIG. 6B in accordance with an exemplary embodiment of the present invention. FIG. 6D is a top view of the light module 150 of FIG. 6A in accordance with an exemplary embodiment of the present invention. FIG. 7 is an exploded view of the light fixture 100 of FIG. 2 having a portion of the reflector 130 cut away in accordance with an exemplary embodiment of the present invention. Referring to FIGS. 1, 2, 3A, 6A-6D, and 7, the light module 150 includes the frame 160, one or more indirect LEDs 270, one or more direct LEDs 380, the lens 190, and one or more active cooling devices 295. However, in certain exemplary embodiments, one or more of the active cooling device 295, the lens 190, and/or the direct LEDs 380 are optional. The light module 150 has a pyramidic shape; however, the shape can be varied in different exemplary embodiments.

The frame 160 includes a central area 610, an indirect LED mounting platform 630, a cut-off wall 638, a direct LED mounting platform 620, and one or fins 640 coupling the central area 610, the direct LED mounting platform 620, and the indirect LED mounting platform 630 to each other. The frame 160 is fabricated using steel, aluminum, or any other suitable conductive material known to people having ordinary skill in the art. The frame 160 channels at least a portion of the heat generated from the LEDs 270 and 380 to the surrounding environment and/or to the pedestal 240. The frame 160 has a top surface 605, an intermediate edge 606, and a bottom surface 607, wherein the intermediate edge 606 is positioned at a vertical elevation that is between the vertical elevations of the top surface 605 and the bottom surface 607. The top surface 605 is circular shaped and is shaped to correspond to the shape of the pedestal 240. The intermediate edge 606 is square shaped. The bottom surface 607 is square shaped. However, in other exemplary embodiments, the top surface 605, the intermediate edge 606, and the bottom surface 607 are shaped in any geometric or non-geometric shape. The intermediate edge 606 encloses an area that is larger than the area enclosed by each of the top surface 605 and the bottom surface 607. The bottom surface 607 encloses an area that is larger than the area enclosed by the top surface 605. In the exemplary embodiment, the frame 160 is integrally formed; however, the frame 160 can be formed in several components and thereafter assembled to form the frame 160.

The central area 610 is recessed into the top surface 605 and is positioned substantially near the center of light module 150; however, in other exemplary embodiments, the central area 610 is planar to the top surface 605 or raised above the top surface 605. The central area 610 includes one or more locking arms 612, which are spaced and configured to mate with the pedestal's tabs 538 (FIG. 5B), and one or more openings 614, which are spaced and configured to mate with the pedestal's screws 537 (FIG. 5B). The locking arms 612 are fabricated from a metal, a plastic, a composite, or any other suitable material that is sufficiently sturdy and resistant to heat produced by the LEDs 270 and 380. In one exemplary embodiment, each locking arm 612 is formed or bent to have at least two sections: a transitional section 710 and an upper section 712. The upper section 712 generally lies parallel to the central area 610. The transitional section 710 lies generally perpendicular or is angled relative to the upper section 712 and the central area 610 so as to raise the upper section 712 above the central area 610. Thus, the transitional section 710 is coupled at one end to the central area 610 and at an opposing end to the upper section 712. The upper section 712 of each locking arm 612 extends sufficiently above the central area 610 such that a corresponding tab 538 (FIG. 5B) of the pedestal 240 slides thereunder, to thereby couple the light module 150 to the pedestal 240. The locking arms 612 are integrally formed with the central area 610, but can be formed separately and thereafter coupled to the central area 610 in other exemplary embodiments. For example, the locking arm 612 are formed by cutting a portion of the central area 610 and bending portions of the material to form the locking arms 612. Alternatively, the locking arms 612 are separately formed and attached to the central area 610 using welding, adhesives, screws, or other methods known to people having ordinary skill in the art. Although one method for coupling the pedestal 240 to the light module 150 is provided herein, other methods known to people having ordinary skill in the art can be used without departing from the scope and spirit of the exemplary embodiment. For example, the light module 150 can be threadedly coupled to the pedestal 240 in certain exemplary embodiments.

The indirect LED mounting platform 630 is located adjacent the intermediate edge 606 and extends around the light module 150 in a square shape such that the pedestal 240 is positioned substantially in the center of the area formed by the indirect LED mounting platform 630; however, the shape of the indirect LED mounting platform 630 can be varied in other exemplary embodiments. The indirect LED mounting platform 630 includes an inner edge 632 and an outer edge 634. The indirect LED mounting platform 630 is sloped such that the inner edge 632 lies on a plane that is above the plane that the outer edge 634 lies. Thus, the indirect LED mounting platform 630 lies at a platform angle 631 measured from the horizontal. In certain exemplary embodiments, the platform angle 631 is about forty-six degrees. In other exemplary embodiments, the platform angle 631 ranges from about twenty degrees to about eighty degrees depending upon the size of the light module 150 and the size of the reflector 130.

The cut-off wall 638 extends substantially upwards from the outer edge 634 to the intermediate edge 606, which lies substantially adjacent a horizontal plane that the inner edge 632 lies. The cut-off wall 638 forms a wall, or a fence, that surrounds the outer edge 634 and provides a cut-off angle 639 for the indirect LEDs 270, which is discussed in further detail below. In certain exemplary embodiments, the cut-off angle 639 is about thirty-nine degrees. In other exemplary embodiments, the cut-off angle 639 ranges from about twenty-five degrees to about fifty degrees depending upon the size of the light module 150 and the size of the reflector 130. In some exemplary embodiments, the cut-off wall 638 also extends slightly downwards from the outer edge 634 towards the direct LED mounting platform 620 and smoothly transitions into the fins 640.

The direct LED mounting platform 620 forms the bottom surface 607, or is included as part of the bottom surface 607, and is square shaped; however, the shape can be varied in other exemplary embodiments. The indirect LED mounting platform 620 is positioned substantially planar and includes an outer perimeter 622. The indirect LED mounting platform 620 lies in a plane that is substantially perpendicular to the pedestal 240.

The fins 640 extend from the indirect LED mounting platform 630 and the cut-off wall 638 to the bottom surface 607 and to the top surface 605, thereby thermally coupling the indirect LED mounting platform 630, the cut-off wall 638, the bottom surface 607, and the top surface 606 to one another. An air channel 642 is formed between each of the fins 640 and facilitates the transfer of heat that is generated from the LEDs 270 and 380 to the surrounding environment. The fins 640 are fabricated using thermally conductive material, for example, steel, aluminum, or any other material known to people having ordinary skill in the art.

According to some exemplary embodiments, the indirect LEDs 270 or LED packages are mounted onto a substrate 670, which is coupled to the indirect LED mounting platform 630 using screws, adhesives, or any other known coupling device. Each substrate 670 extends the length of each side of the indirect LED mounting platform 630. Hence, the indirect LEDs 270 are positioned at the same angle as the indirect LED mounting platform 630 and are directionally positioned to illuminate the reflector's interior surface 139 and prevent illumination beyond the edges 135, 136, 137, and 138 of the reflector 130. The cut-off wall 638 assists to ensure that illumination from the indirect LEDs 270 does not go beyond the reflector edges 135, 136, 137, and 138.

There are six indirect LEDs 270 or LED packages mounted onto each substrate 670. There are four substrates 670 coupled to the indirect LED mounting platform 630, where each substrate 670 forms a side of a square. However, in alternative exemplary embodiments, the number of substrates 670 is fewer or greater and can be configured to form any geometric or non-geometric shape. Additionally, the number of indirect LEDs 270 or LED packages mounted onto each substrate 670 is greater or fewer in alternative exemplary embodiments. Each indirect LED 270 on a respective substrate 670 is spaced about twenty-four millimeters from one another, measured from the midpoint of each indirect LED 270. However, in alternative exemplary embodiments, this distance is greater or less depending upon the desired illumination characteristics. The distance between the first indirect LED 270 and the last indirect LED 270 on a respective substrate 670 is about 127 millimeters; however, this distance also is alterable depending upon the length of the substrate 670 and the desired illumination characteristics. Once the substrate 670 is mounted onto the indirect LED mounting platform 630, the vertical distance component from the upper edge of the substrate 670 to the midpoint of the indirect LED 270 is about three millimeters; however, this distance can be increased or decreased in other exemplary embodiments.

According to this exemplary embodiment, the substrate 670 includes one or more sheets of ceramic, metal, laminate, circuit board, mylar, or another material. Each indirect LED 270 includes a chip of semi-conductive material that is treated to create a positive-negative ("p-n") junction. When the indirect LED 270 or LED package is electrically coupled to a power source, such as the driver 110, current flows from the positive side to the negative side of each junction, causing charge carriers to release energy in the form of incoherent light.

The wavelength or color of the emitted light depends on the materials used to make the indirect LED 270 or LED package. For example, a blue or ultraviolet LED typically includes gallium nitride ("GaN") or indium gallium nitride ("InGaN"), a red LED typically includes aluminum gallium arsenide ("AlGaAs"), and a green LED typically includes aluminum gallium phosphide ("AlGaP"). Each of the indirect LEDs 270 in the LED package can produce the same or a distinct color of light. For example, in certain exemplary embodiments, the LED package include one or more white LED's and one or more non-white LEDs, such as red, yellow, amber, or blue LEDs, for adjusting the color temperature output of the light emitted from the luminaire. A yellow or multi-chromatic phosphor may coat or otherwise be used in a blue or ultraviolet LED to create blue and red-shifted light that essentially matches blackbody radiation. The emitted light approximates or emulates "white," incandescent light to a human observer. In certain exemplary embodiments, the emitted light includes substantially white light that seems slightly blue, green, red, yellow, orange, or some other color or tint. In certain exemplary embodiments, the light emitted from the indirect LEDs 270 has a color temperature between 2500 and 5000 degrees Kelvin.

In certain exemplary embodiments, an optically transmissive or clear material (not shown) encapsulates at least a portion of each indirect LED 270 or LED package. This encapsulating material provides environmental protection while transmitting light from the indirect LEDs 270. In certain exemplary embodiments, the encapsulating material includes a conformal coating, a silicone gel, a cured/curable polymer, an adhesive, or some other material known to a person of ordinary skill in the art having the benefit of the present disclosure. In certain exemplary embodiments, phosphors are coated onto or dispersed in the encapsulating material for creating white light. In certain exemplary embodiments, the white light has a color temperature between 2500 and 5000 degrees Kelvin.

In certain exemplary embodiments, the indirect LED 270 is an LED package that includes one or more arrays of LEDs 270 that are collectively configured to produce a lumen output from 1 lumen to 5000 lumens. The indirect LEDs 270 or the LED packages are attached to the substrate 670 by one or more solder joints, plugs, epoxy or bonding lines, and/or other means for mounting an electrical/optical device on a surface. The substrate 670 is electrically connected to support circuitry (not shown) and/or the LED driver for supplying electrical power and control to the indirect LEDs 270 or LED packages. For example, one or more wires (not shown) couple opposite ends of the substrate 670 to the driver 110, thereby completing a circuit between the driver 110, the substrate 670, and the indirect LEDs 270. In certain exemplary embodiments, the driver 110 is configured to separately control one or more portions of the indirect LEDs 270 in the array to adjust light color or intensity.

According to some exemplary embodiments, the direct LEDs 380 or LED packages are mounted onto a substrate 680, which is coupled to the direct LED mounting platform 620 using screws, adhesives, or any other known coupling device. The substrate 680 is mounted to the direct LED mounting platform 620 so that it faces a desired illumination surface, which is located in a direction that is opposite of the direction that the reflector 130 lies. Hence, the direct LEDs 380 are positioned in a parallel plane as the plane that the direct LED mounting platform 620 is positioned in. The direct LEDs 380 are directionally positioned to directly illuminate the desired illumination surface.

There are three direct LEDs 380 or LED packages mounted onto each substrate 680. There is a single substrate 680 coupled to the direct LED mounting platform 620. However, in alternative exemplary embodiments, the number of substrates 680 is fewer or greater. Additionally, the number of direct LEDs 380 or LED packages mounted onto each substrate 680 is greater or fewer in alternative exemplary embodiments.

According to this exemplary embodiment, the substrate 680 includes one or more sheets of ceramic, metal, laminate, circuit board, mylar, or another material. Each direct LED 380 includes a chip of semi-conductive material that is treated to create a positive-negative ("p-n") junction. When the direct LED 380 or LED package is electrically coupled to a power source, such as the driver 110, current flows from the positive side to the negative side of each junction, causing charge carriers to release energy in the form of incoherent light.

The wavelength or color of the emitted light depends on the materials used to make the direct LED 380 or LED package. For example, a blue or ultraviolet LED typically includes gallium nitride ("GaN") or indium gallium nitride ("InGaN"), a red LED typically includes aluminum gallium arsenide ("AlGaAs"), and a green LED typically includes aluminum gallium phosphide ("AlGaP"). Each of the direct LEDs 380 in the LED package can produce the same or a distinct color of light. For example, in certain exemplary embodiments, the LED package include one or more white LED's and one or more non-white LEDs, such as red, yellow, amber, or blue LEDs, for adjusting the color temperature output of the light emitted from the luminaire. A yellow or multi-chromatic phosphor may coat or otherwise be used in a blue or ultraviolet LED to create blue and red-shifted light that essentially matches blackbody radiation. The emitted light approximates or emulates "white," incandescent light to a human observer. In certain exemplary embodiments, the emitted light includes substantially white light that seems slightly blue, green, red, yellow, orange, or some other color or tint. In certain exemplary embodiments, the light emitted from the direct LEDs 380 has a color temperature between 2500 and 5000 degrees Kelvin.

In certain exemplary embodiments, an optically transmissive or clear material (not shown) encapsulates at least a portion of each direct LED 380 or LED package. This encapsulating material provides environmental protection while transmitting light from the direct LEDs 380. In certain exemplary embodiments, the encapsulating material includes a conformal coating, a silicone gel, a cured/curable polymer, an adhesive, or some other material known to a person of ordinary skill in the art having the benefit of the present disclosure. In certain exemplary embodiments, phosphors are coated onto or dispersed in the encapsulating material for creating white light. In certain exemplary embodiments, the white light has a color temperature between 2500 and 5000 degrees Kelvin.

In certain exemplary embodiments, the direct LED 380 is an LED package that includes one or more arrays of LEDs 380 that are collectively configured to produce a lumen output from 1 lumen to 5000 lumens. The direct LEDs 380 or the LED packages are attached to the substrate 680 by one or more solder joints, plugs, epoxy or bonding lines, and/or other means for mounting an electrical/optical device on a surface. The substrate 680 is electrically connected to support circuitry (not shown) and/or the LED driver for supplying electrical power and control to the direct LEDs 380 or LED packages. For example, one or more wires (not shown) couple opposite ends of the substrate 680 to the driver 110, thereby completing a circuit between the driver 110, the substrate 680, and the direct LEDs 380. In certain exemplary embodiments, the driver 110 is configured to separately control one or more portions of the direct LEDs 380 in the array to adjust light color or intensity.

The lens 190 is disposed over the direct LEDs 380 and the direct LED mounting platform 620 to collectively encapsulate the direct LEDs 380. The lens 190 is coupled to the perimeter of the direct LED mounting platform 620 using brackets (not shown) or other fasteners that are known to people having ordinary skill in the art. In one exemplary embodiment, the lens 190 is fabricated from an optically transmissive material or clear material including, but not limited to, plastic, glass, silicone, or other material known to people having ordinary skill in the art. According to certain exemplary embodiments, the lens 190 encapsulates at least some of the direct LEDs 380 individually. The lens 190 provides environmental protection while allowing light emitted by the direct LEDs 380 to pass therethrough toward the desired illumination area. In certain other exemplary embodiments, the lens 190 focuses light toward the desired illumination area and creates a desired light distribution. In certain exemplary embodiments, the lens 190 diffuses the light emitted from the direct LEDs 380. In yet another exemplary embodiments, the lens 190 creates an insulation between the direct LEDs 380 and human contact. The lens 190 has a pyramid shape; however, the lens 190 is formed into other geometric and non-geometric shapes in other exemplary embodiments.

The active cooling device 195 provides active cooling of one or more fins 640. The active cooling device 195 is optional and is not present within some of the exemplary embodiments. One example of the active cooling device 195 is a SynJet®, which is manufactured by Nuventix Corporation located in Austin, Tex. According to the exemplary embodiment, the active cooling device 195 includes a diaphragm (not shown) positioned within a chamber (not shown), wherein the diaphragm oscillates from a first position to a second position. When the diaphragm moves from the first position to the second position, ambient air enters the chamber. When the diaphragm moves from the second position to the first position, the air within the chamber is expelled along the surface of one or more fins 640 in a turbulent manner. The active cooling device 195 is placed between each fin 640 adjacent to the perimeter of the central area 610 according to some of the exemplary embodiments. In yet other exemplary embodiments, greater or fewer active cooling devices 195 is used depending upon the cooling of the fins 640 that is desired. Additionally, the location of the active cooling devices 195 is alterable. Although one exemplary active cooling device 195 is described herein, other types of active cooling devices 195 can be used without departing from the scope and spirit of the exemplary embodiment.

Once the pedestal 240 is coupled to the bracket 220 and the light module 150 is coupled to the pedestal 240, the indirect LEDs 270 are positioned in a plane that is about ten and one-half millimeters below the plane that the edges 235, 236, 237, and 238 lie. However, in other exemplary embodiments, this distance that indirect LEDs 270 are positioned below the plane that the edges 235, 236, 237, and 238 lie is varied depending upon the size of the reflector 130 and the cut-off angle 639 formed with the cut-off wall 638. In certain exemplary embodiments, both the frame 160 of the light module 150 and the pedestal 240 provide thermal management for the LEDs 270 and 380. The pedestal 240 and the frame 160 are visible to an observer standing in the desired illumination area; however, the direct LEDs 270 are not visible to the observer standing in the desired illumination area. The illumination provided on the desired illumination area is a result of the illumination generated from the indirect LEDs 270 and the direct LEDs 380. The light emitted from the indirect LEDs 270 is directed to the internal surface 139 of the reflector 130 and is then reflected downward to the desired illuminated area. The light emitted from the direct LEDs 380 is directed directly to the desired illuminated area through the lens 190.

Figure 8:
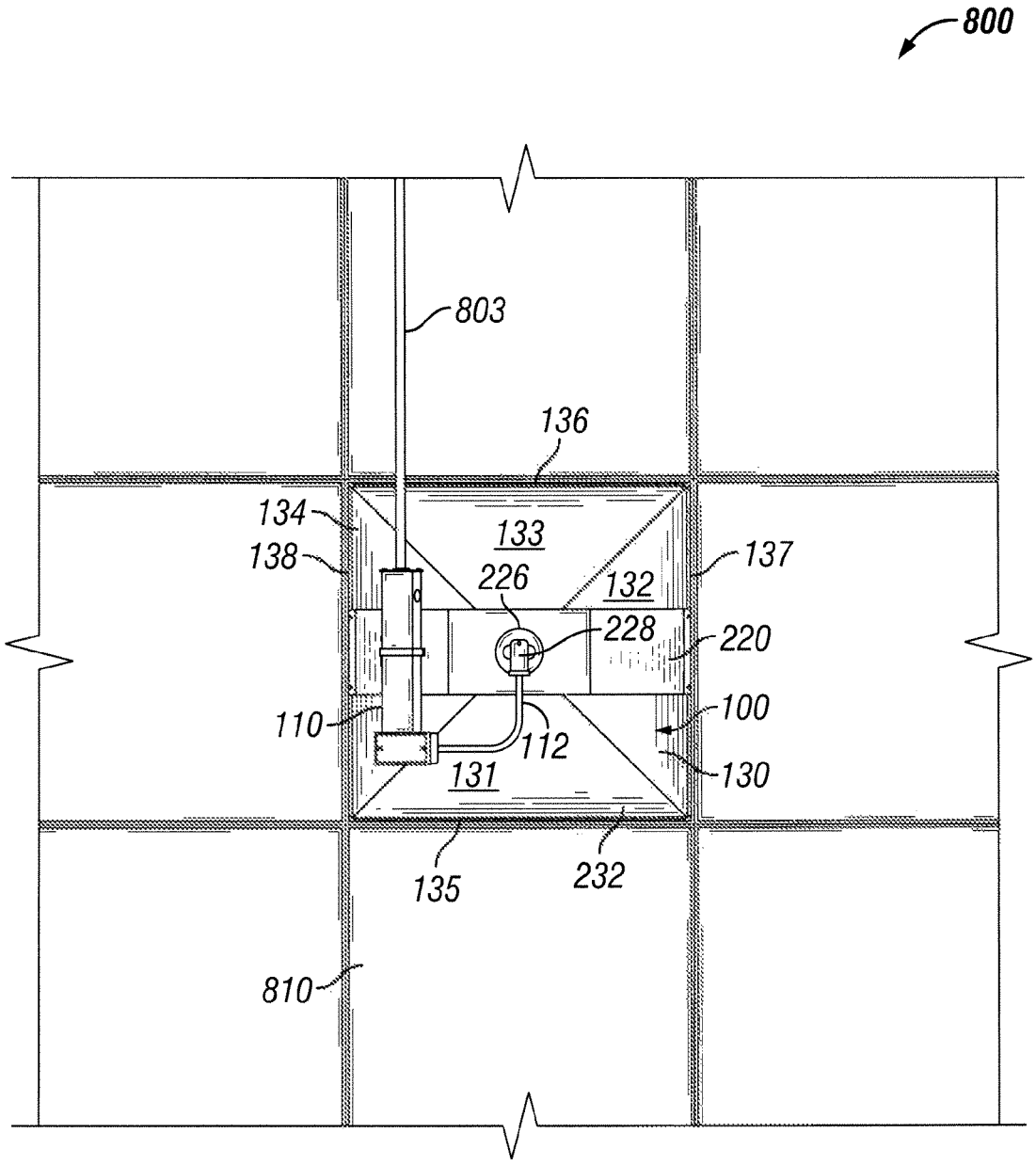
FIG. 8 is a top view of the light fixture of FIG. 1 installed within a ceiling grid in accordance with an exemplary embodiment of the present invention.

FIG. 8 is a top view of the light fixture 100 of FIG. 1 installed within a ceiling grid 800 in accordance with an exemplary embodiment of the present invention. The ceiling grid 800 includes one or more ceiling tiles 810 and at least one light fixture 100. In certain exemplary embodiments, the light fixture 800 is dimensioned similar to the dimensions of a ceiling tile 810 so that the light fixture 100 replaces one of the ceiling tiles 810. However, in other exemplary embodiments, the light fixture 100 is dimensioned to replace more than one ceiling tile 810; for example, two ceiling tiles 810 adjacent to one another are replaced, three ceiling tiles 810 in a row are replaced, or four ceiling tiles in a two by two array are replaced.

According to FIG. 8, the exterior surface 232 of the reflector 130 is seen. The reflector 130 includes the first part 131, the second part 132, the third part 133, and the fourth part 134. As previously mentioned, the first part 131 includes the first lateral edge 135 and is adjacent the second part 132 and the fourth part 134, but is opposite the third part 133. The second part 132 includes the first longitudinal edge 137 and is adjacent the first part 131 and the third part 133, but is opposite the fourth part 134. The third part 133 includes the second lateral edge 136 and is adjacent the second part 132 and the fourth part 134, but is opposite the first part 131. The fourth part 134 includes the second longitudinal edge 138 and is adjacent the first part 131 and the third part 133, but is opposite the second part 132. Each of the four parts 131, 132, 133, and 134 are substantially similar in size and collectively form a square-shaped reflector, or a rectangular-shaped reflector according to other exemplary embodiments, that replaces one or more ceiling tiles 810.

The bracket 220 is coupled to opposing ends of the reflector 130. Specifically, according to one exemplary embodiment, the bracket 220 is coupled to a portion of the first longitudinal edge 137 and extends the latitudinal length of the reflector 130 to a portion of the second longitudinal edge 138. The bracket 220 is raised from at least a portion of the exterior surface 232 of the reflector 130. The bracket 220 is coupled to both longitudinal edges 137 and 138 according to methods previously described. The bracket 220 includes the aperture 226 substantially centrally located lengthwise. The aperture 226 is aligned with the opening 405 (FIG. 4) so that the bracket 220 is capable of providing support to the pedestal 240 (FIG. 2). The bracket 220 is used for supporting the driver 110 and/or the pedestal 240 (FIG. 2).

The driver 110 is electrically communicable with the light module 150 (FIG. 1) using the cable 112. The driver receives power from a power source (not shown) via one or more building cables 803. The driver 110 delivers power to the light module 150 (FIG. 1) using the cable 112. One end of the cable is coupled to the driver 110, while the other end is coupled to the connector 228, which is coupled to the bracket 220 and lies above the aperture 226. Specifically, the driver 110 provides power to the indirect LEDs 270 (FIG. 2), the direct LEDs 380 (FIG. 3), and the active cooling device 295 (FIG. 2).

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A light fixture, comprising:

a reflector;

a heat sink coupled to the reflector by a body; and one or more light sources coupled to the heat sink and comprising one or more first light emitting diodes ("LEDs"), the first LEDs emitting light directly towards an interior surface of the reflector in a direction away from a desired illumination area, wherein the first LEDs are not visible from directly below the light fixture, wherein at least a portion of the heat sink is positioned below a ceiling when the reflector is mounted within the ceiling, and wherein the heat sink and the body perform thermal management of the heat emitted from the one or more light sources.

2. The light fixture of claim 1, wherein one or more light sources comprise one or more second LEDs, wherein the second LEDs are visible from directly below the light fixture.

3. The light fixture of claim 1, wherein at least one first LED is positioned below the lowest portion of the reflector.

4. The light fixture of claim 1, wherein the heat sink comprises a frame, the frame comprising:

a top surface;

a bottom surface;

an intermediate edge positioned at a vertical elevation that is between the vertical elevations of the top surface and the bottom surface;

a first LED mounting platform located adjacent to the intermediate edge, the first LED mounting platform comprising an inner edge and an outer edge, the inner edge positioned at a vertical elevation that is higher than the vertical elevation of the outer edge;

a cut-off wall extending from the outer edge to the intermediate edge; and one or more fins coupled to the cut-off wall and the first LED mounting platform and extending to the top surface and the bottom surface, wherein one or more first LEDs are coupled to the first LED mounting platform, wherein the cut-off wall forms a cut-off angle of the first LEDs.

5. The light fixture of claim 4, wherein the cut-off angle ranges between about twenty-five degrees and about fifty degrees.

6. The light fixture of claim 4, wherein one or more light sources comprise one or more second LEDs, wherein the bottom surface comprises a second LED mounting platform facing the desired illumination area, and wherein the second LEDs are coupled to the second LED mounting platform and emit light directly towards the desired illumination area.

7. The light fixture of claim 6, further comprising a lens coupled to the second LED mounting platform, the lens positioned over the second LEDs.

8. The light fixture of claim 1, further comprising one or more active cooling devices coupled to the heat sink, wherein the heat sink comprises one or more fins, the active cooling device providing thermal management across the one or more fins.

9. The light fixture of claim 8, further comprising a driver electrically coupled to and supplying power to at least the first LEDs and the active cooling device.

10. The light fixture of claim 1, wherein the heat sink is rotatably coupleable to the body.

11. The light fixture of claim 1, wherein the body is hollow.

12. The light fixture of claim 1, wherein the light sources generate heat, at least a portion of the heat is transferred to at least the heat sink, the heat sink releasing at least a portion of the heat to an environment surrounding the heat sink, the environment being below the ceiling.

13. A light fixture, comprising:

a reflector;

a heat sink positioned elevationally below a portion of the reflector by a body; and one or more light sources coupled to the heat sink and comprising one or more light emitting diodes ("LEDs"), the LEDs emitting light directly towards an interior surface of the reflector in a direction away from a desired illumination area, wherein the LEDs are not visible from directly below the light fixture, wherein the heat sink is positioned below an upper portion of the reflector when the reflector is disposed within a ceiling, and wherein at least a portion of the body extends through the reflector.

14. The light fixture of claim 13, wherein the light sources generate heat, at least a portion of the heat is transferred to at least the heat sink, the heat sink releasing at least a portion of the heat to an environment surrounding the heat sink, the environment being an air-conditioned space.

15. The light fixture of claim 13, further comprising a mounting device positioned above at least a portion of the reflector, wherein the body is coupled to the mounting device.

16. The light fixture of claim 13, wherein the body is coupled to the reflector.

17. A light fixture, comprising:

a reflector;

a heat sink coupled to the reflector by a body, the heat sink comprising one or more fins;

one or more light sources coupled to the heat sink and comprising one or more first light emitting diodes ("LEDs"), the first LEDs emitting light directly towards an interior surface of the reflector in a direction away from a desired illumination area, wherein the first LEDs are not visible from directly below the light fixture, and one or more active cooling devices coupled to the heat sink, the one or more active cooling devices providing thermal management across the one or more fins, wherein at least a portion of the heat sink is positioned below a ceiling when the reflector is mounted within the ceiling.

18. The light fixture of claim 17, further comprising a driver electrically coupled to and supplying power to at least the first LEDs and the one or more active cooling devices.

19. A light fixture, comprising:

a reflector;

a heat sink coupled to the reflector by a body; and one or more light sources coupled to the heat sink and comprising one or more first light emitting diodes ("LEDs"), the first LEDs emitting light directly towards an interior surface of the reflector in a direction away from a desired illumination area, wherein the first LEDs are not visible from directly below the light fixture, wherein at least a portion of the heat sink is positioned below a ceiling when the reflector is mounted within the ceiling, and wherein the heat sink is rotatably coupleable to the body.

20. A light fixture, comprising:

a reflector;

a heat sink positioned elevationally below a portion of the reflector by a body; and one or more light sources coupled to the heat sink and comprising one or more light emitting diodes ("LEDs"), the LEDs emitting light directly towards an interior surface of the reflector in a direction away from a desired illumination area, wherein the LEDs are not visible from directly below the light fixture, wherein the heat sink is positioned below an upper portion of the reflector when the reflector is disposed within a ceiling, and wherein the heat sink and the body perform thermal management of the heat emitted from the one or more light sources.

21. The light fixture of claim 20, wherein one or more light sources comprise one or more second LEDs, wherein the second LEDs are visible from directly below the light fixture.

22. The light fixture of claim 21, further comprising a lens positioned over the one or more second LEDs.

* * * * *